US011739774B1

(12) United States Patent
Schmidt et al.

(10) Patent No.: US 11,739,774 B1
(45) Date of Patent: Aug. 29, 2023

(54) FLOW MODIFYING DEVICE WITH PERFORMANCE ENHANCING VANE STRUCTURE

(71) Applicant: Vortex Pipe Systems LLC, Austin, TX (US)

(72) Inventors: Paul Wayne Schmidt, Carlton, OR (US); Avijit Ghosh, Austin, TX (US)

(73) Assignee: Vortex Pipe Systems LLC, Austin, TX (US)

( * ) Notice: Subject to any disclaimer, the term of this patent is extended or adjusted under 35 U.S.C. 154(b) by 0 days.

(21) Appl. No.: 18/161,626

(22) Filed: Jan. 30, 2023

(51) Int. Cl.
*F15D 1/02* (2006.01)
*F15D 1/00* (2006.01)

(52) U.S. Cl.
CPC ..... *F15D 1/0045* (2013.01); *F15D 1/001* (2013.01)

(58) Field of Classification Search
CPC ..... F16D 1/065; F16L 55/02772
USPC ..... 138/39, 115, 116, 117
See application file for complete search history.

(56) References Cited

U.S. PATENT DOCUMENTS

| | | | | |
|---|---|---|---|---|
| 1,496,345 | A | 6/1924 | Lichtenhaeler | |
| 1,500,103 | A | 7/1924 | Burdon et al. | |
| 1,513,624 | A | 10/1924 | Parker | |
| 1,777,141 | A | 9/1930 | Howden | |
| 1,959,907 | A | 5/1934 | Ebert | |
| 1,974,110 | A | 9/1934 | Higley | |
| 2,274,599 | A | 2/1942 | Freeman | |
| 2,300,130 | A | 10/1942 | McCurdy | |
| 2,784,948 | A | 3/1957 | Pahl et al. | |
| 2,816,518 | A | 12/1957 | Daggett | |
| 2,831,754 | A | 4/1958 | Manka | |
| 3,827,461 | A * | 8/1974 | Gilman | G01F 15/00 48/189.4 |
| 3,949,970 | A * | 4/1976 | ter Braak | F28F 13/12 239/432 |
| 4,204,775 | A | 5/1980 | Speer | |
| 4,339,918 | A | 7/1982 | Michikawa | |
| 4,474,726 | A | 10/1984 | Ohta et al. | |

(Continued)

FOREIGN PATENT DOCUMENTS

| | | | |
|---|---|---|---|
| EP | 1134476 | A1 | 9/2001 |
| GB | 2312276 | A | 10/1997 |
| RU | 2670283 | C1 | 10/2018 |

OTHER PUBLICATIONS

International Search Authority, Notification of Transmittal of the International Search Report and Written Opinion of the International Search Authority, PCT/US2019/0151468, 14 pages.

*Primary Examiner* — James F Hook
(74) *Attorney, Agent, or Firm* — David O. Simmons; IVC Patent Agency

(57) ABSTRACT

A flow modifying device comprises an outer shell, a central tube within an interior space of the outer shell, and a plurality of helix vanes within the interior space. The central tube extends along at least a portion of a length of the outer shell. Each of the helix vanes extend along the outer shell and along the central tube. An outer edge portion of each of the helix vanes is attached to the outer shell and an inner edge portion of each of the helix vanes is located within a central passage of the central tube. In this manner, a first portion of each of the helix vanes extends between the outer shell and the central tube and a second portion of each of the helix vanes is located within the central passage of the central tube.

20 Claims, 7 Drawing Sheets

(56) References Cited

U.S. PATENT DOCUMENTS

| | | | | |
|---|---|---|---|---|
| 5,309,946 | A * | 5/1994 | Ligneul | F15D 1/02 366/337 |
| 5,423,353 | A | 6/1995 | Sorensen | |
| 5,727,598 | A | 3/1998 | Stuhlreyer | |
| 5,743,637 | A | 4/1998 | Ogier | |
| 5,765,598 | A | 6/1998 | Goddard et al. | |
| 5,909,959 | A | 6/1999 | Gerich | |
| 5,992,465 | A | 11/1999 | Jansen | |
| 6,564,831 | B1 | 5/2003 | Sanoner et al. | |
| 7,849,885 | B2 | 12/2010 | Olsen et al. | |
| 8,033,714 | B2 | 10/2011 | Nishioka et al. | |
| 8,322,381 | B1 * | 12/2012 | Glanville | B01F 25/43151 366/337 |
| 8,955,553 | B2 | 2/2015 | Sheldrake et al. | |
| 10,092,886 | B2 | 10/2018 | Kashihara et al. | |
| 10,201,786 | B2 | 2/2019 | Okada et al. | |
| 11,221,028 | B1 * | 1/2022 | Schmidt | B01F 25/432 |
| 11,378,110 | B1 * | 7/2022 | Schmidt | F15D 1/02 |
| 2006/0245945 | A1 * | 11/2006 | Wilson | F04D 19/022 417/405 |
| 2008/0308169 | A1 | 12/2008 | Nielsen et al. | |
| 2010/0307830 | A1 | 9/2010 | Poyyapakkam et al. | |
| 2012/0285173 | A1 | 11/2012 | Poyyapakkam et al. | |
| 2016/0270893 | A1 | 9/2016 | Tapocik | |
| 2017/0306994 | A1 | 10/2017 | Schmidt et al. | |
| 2021/0396252 | A1 * | 12/2021 | Schmidt | B01F 25/60 |

* cited by examiner

-Prior Art-

FLOW MODIFYING DEVICE WITH PERFORMANCE ENHANCING VANE STRUCTURE

FIELD OF THE DISCLOSURE

The disclosures made herein relate generally to fluid flow control devices and, more particularly, to devices used for beneficially modifying flow attributes of a flowable material to improve fluid low efficiency.

BACKGROUND

The need to flow materials (i.e., flowable material) through a flow conduit and is well known. Examples of such materials include, but are not limited to, fluids, liquids, slurries, particulates, flowable aggregate, and the like. Examples of such flow conduit include, but are not limited to, pipes, pipelines, conduits, tubular flow members, in-situ fluid-defined conduits of a marine propulsion system, and the like.

As shown in FIG. 1, conventional (i.e., non-modified/straight flowing) flow of liquid 5 (i.e., a flowable material) within a flow passage 10 of a flow conduit 15 has a flow profile characterized by laminar flow effect (i.e., laminar flow 20). The laminar flow effect is characterized by a parabolic flow profile resulting from a laminar boundary layer along an interior surface defining the flow passage 10 of the flow conduit 15. Liquid 5 at the surface of the flow passage 10 exhibits considerable friction and zero flow velocity, thereby reducing velocity of the liquid 5 even at a considerable distance from the surface of the flow passage 10. In association with this reduced velocity, the laminar flow effect is known to increase backpressure within a flow conduit and result in head loss and heating of a fluid flowing therethrough.

Therefore, a device that overcomes drawbacks arising from laminar flow of material through a flow conduit would be beneficial, desirable and useful.

SUMMARY OF THE DISCLOSURE

Embodiments of the disclosures made herein are directed to a flow modifying device that overcomes drawbacks arising from laminar flow of material through a flow conduit. A flow modifying device in accordance with one or more embodiments of the disclosures made herein provides for flow of flowable material within a flow passage of a flow conduit (e.g., a portion of a pipeline, tubing, propulsion housing, or the like) to have a cyclonic flow (i.e., vortex or swirling) profile. Advantageously, such a cyclonic flow profile centralizes flow toward the central portion of the flow passage, thereby reducing magnitude of laminar flow. Such cyclonic flow profile provides a variety of other advantages as compared to a parabolic flow profile resulting from laminar flow (e.g., increased flow rate, reduce inner pipeline wear, more uniform inner pipe wear, reduction in energy consumption, reduced or eliminated slugging and the like). Accordingly, flow modifying devices in accordance with one or more embodiments of the disclosures made herein may be used in a variety of applications including, but not limited to material transport, material delivery, fluid-driven propulsion, and other suitable applications.

Embodiments of material flow modifying devices in accordance with disclosure made herein create cyclonic (i.e., rotational, vortex) flow in a recirculation (i.e., mixing) zone that is downstream of a vortex flow inducer of the device (sometimes also referred to as a vortex chamber). The vortex flow inducer comprises an outer shell having helical vanes and a central tube extending around and along a centerline longitudinal axis of the outer shell. Notably, vanes of material flow modifying devices in accordance with disclosure made herein extend, preferably contiguously, from an interior surface of the outer shell into a central passage of the central tube (i.e., inner edge portions of the vanes are located within the central passage).

As discussed below in greater detail, flow modifying devices in accordance with embodiments of the disclosures made herein advantageously drive flowable material flow toward a focal point along a centerline axis of the vortex flow inducer at a location that is downstream of the vortex flow inducer. The location of the focal point is a function of material flow volume in relationship to the diameter of an upstream inlet pipe connected to an inlet of the flow modifying device. The combination of the focal points location and flowable material (e.g., fluid) velocity creates and determines the distance of beneficial suction (i.e., siphoning) action pulling fluid into the flow modifying device from the upstream inlet pipe.

Without the focal point functionality, material flow leaving the flow modifying device would be that of a centrifuge—i.e., material being undesirably accelerated and driven toward the interior surface of the flow conduit. In contrast, by driving the flowable material toward the centerline axis of the vortex flow inducer, the amount of flowable material at the interior surface of the flow conduit is greatly reduced as compared to laminar flow or centrifuge-induced flow. Additionally, by driving flowable material flow toward the focal point of the flow modifying device, a portion of the flowable material (i.e., generally non-rotating flowable material) becomes trapped between the inside surface of the flow conduit (e.g., pipeline) and the exterior boundary of the rotationally flowing flowable material, thereby becoming an interface material for the rotationally flowing flowable material that serves to lower the effective coefficient of friction exhibited at the exterior boundary of the rotationally flowing flowable material (i.e., flowing of flowable material upon like material as opposed to flowing of the material upon material of the flow conduit).

As compared to a flow modifying device of the same construction as that of embodiments of the disclosures made herein but without vanes thereof that reside (e.g., extend contiguously into) the central passage of the central tube, flow modifying devices in accordance with the disclosures made herein advantageously create the aforementioned vortex flow at a lower flow rate (i.e., material velocity). In this regard, flow modifying devices in accordance with the disclosures made herein exhibit enhanced flow modifying performance with materials moving at a lower velocity. Thus, flow modifying devices in accordance with the disclosures made herein are preferably configured for pumping applications with an undersized pump, variable pipe sizes, non-optimized pipe networks, and the like.

In one or more embodiments of the disclosures made herein, a flow modifying device comprises an outer body, a plurality of vanes, and a plurality of elongated bodies. Each vane extends in a helical manner within the outer body along at least a portion of a length of the outer body. At least a portion of an outer edge portion of each of the vanes is attached to the outer body. An inner edge portion of each of the vanes is located adjacent to a centerline longitudinal axis of the outer body. The inner edge portion of each of the vanes is spaced away from the inner edge portion of each other one of the vanes. Each elongated body extends between respective adjacent ones of the vanes. Each of the adjacent vanes is attached to the elongated body extending therebetween. The elongated bodies and the vanes jointly define a central passage extending along the centerline longitudinal axis of the outer body. Each of the elongated bodies is located at a position between the outer and inner edge portions of each of the respective adjacent ones of the vanes.

In one or more embodiments of the disclosures made herein, a flow modifying device comprises an outer shell, a central tube within an interior space of the outer shell, and a plurality of helix vanes within the interior space. The central tube extends along at least a portion of a length of the outer shell. Each of the helix vanes extend along at least a portion of a length of the outer shell and along at least a portion of a length of the central tube. At least a portion of an outer edge portion of each of the helix vanes is attached to the outer shell and an inner edge portion of each of the helix vanes is located within a central passage of the central tube such that a first portion of each of the helix vanes extends between the outer shell and the central tube and a second portion of each of the helix vanes is located within the central passage of the central tube.

In one or more embodiments of the disclosures made herein, a flow modifying device comprises an outer shell that is conically shaped, a central tube within an interior space of the outer shell, and a plurality of vanes extending in a helical manner within the outer shell. The central tube is cylindrically shaped. The central tube extends along at portion of a length of the outer shell such that a length of the central tube is less than the length of the outer shell. Each of the vanes extend along at least a portion of a length of the outer shell and along at least a portion of a length of the central tube. At least a portion of an outer edge portion of each of the vanes is integral with the outer shell and an inner edge portion of each of the vanes is located within a central passage of the central tube such that a first portion of each of the vanes extends between the outer shell and the central tube and a second portion of each of the vanes is located within the central passage of the central tube. Each of the vanes extends contiguously from the outer edge portion thereof to the inner edge portion thereof. Adjacent ones of the vanes, the outer shell and the central tube jointly define a respective helical fluid flow passage.

In one or more embodiments, each of the vanes extends contiguously from the outer edge portion thereof to the inner edge portion thereof.

In one or more embodiments, the outer body is a shell that is conically shaped.

In one or more embodiments, the vanes and the elongated bodies jointly define a central tube that is cylindrically shaped.

In one or more embodiments, the central passage extends through the central tube.

In one or more embodiments, the outer body is conically shaped.

In one or more embodiments, each elongated body is located adjacent to the inner edge portion of the adjacent ones of the vanes.

In one or more embodiments, an upstream end of all of the vanes lay on an upstream reference plane, an upstream end of all of the elongated bodies lay on the upstream reference plane, and the upstream reference plane extends perpendicular to the centerline longitudinal axis of the outer body.

In one or more embodiments, a downstream end face of all of the vanes lay on a downstream reference plane that extends parallel to the upstream reference plane, a downstream end face of all of the elongated bodies are located at a position between the upstream and downstream reference planes, and all of the elongated bodies are the same length.

These and other objects, embodiments, advantages and/or distinctions of the present invention will become readily apparent upon further review of the following specification, associated drawings and appended claims.

DETAILED DESCRIPTION

Figure 1:
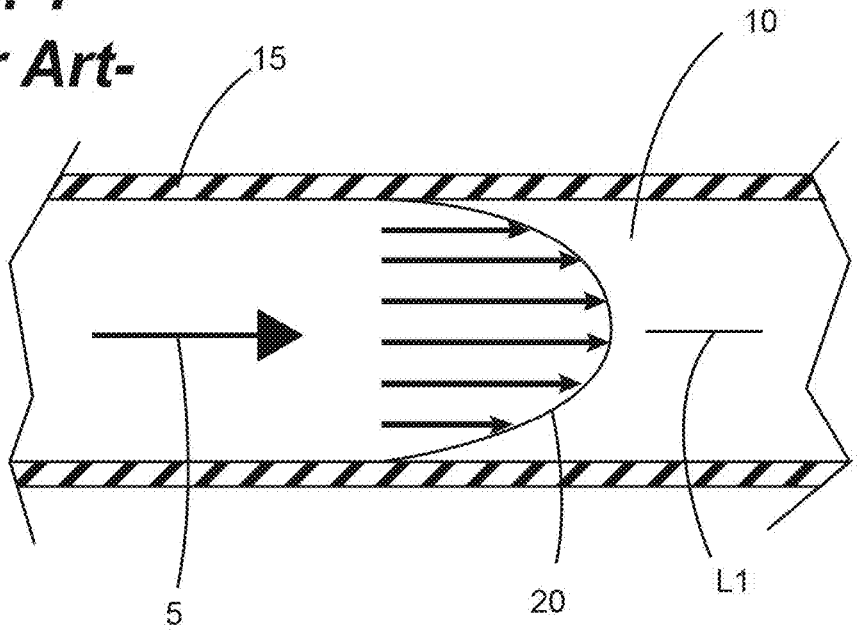
FIG. 1 is a diagrammatic view showing laminar flow effect within a flow conduit.

Embodiments of the disclosures made herein are directed to flow modifying devices. Such flow modifying devices are preferably passive devices that have no parts that actively (i.e., non-passively) move during operation. Rather, these flow modifying devices operate passively on the basis of an existing flow velocity provided by a pumping system. Accordingly, when a flowable material exhibits sufficient flow velocity, a flow modifying device in accordance with the disclosures made herein subject to such flowable material is preferably always operational.

As discussed above in reference to FIG. 1, conventional flow of liquid 5 within the flow passage 10 of the flow conduit 15 has a flow profile characterized by laminar flow effect (i.e., laminar flow 20). However, flow modifying devices in accordance with the disclosures made herein (e.g., the flow modifying device 100 shown in FIGS. 3-9) are advantageously configured in a manner that causes fluid flow to be transformed from a flow profile characterized by laminar flow effect to a flow profile being characterized by rotational flow effect 25, as shown in FIG. 2. The rotational flow effect 25 is the result of rotational movement of the fluid 5 about the longitudinal axis L1 of the flow conduit 15 as generated by flow modifying devices in accordance with the disclosures made herein.

Figure 2:
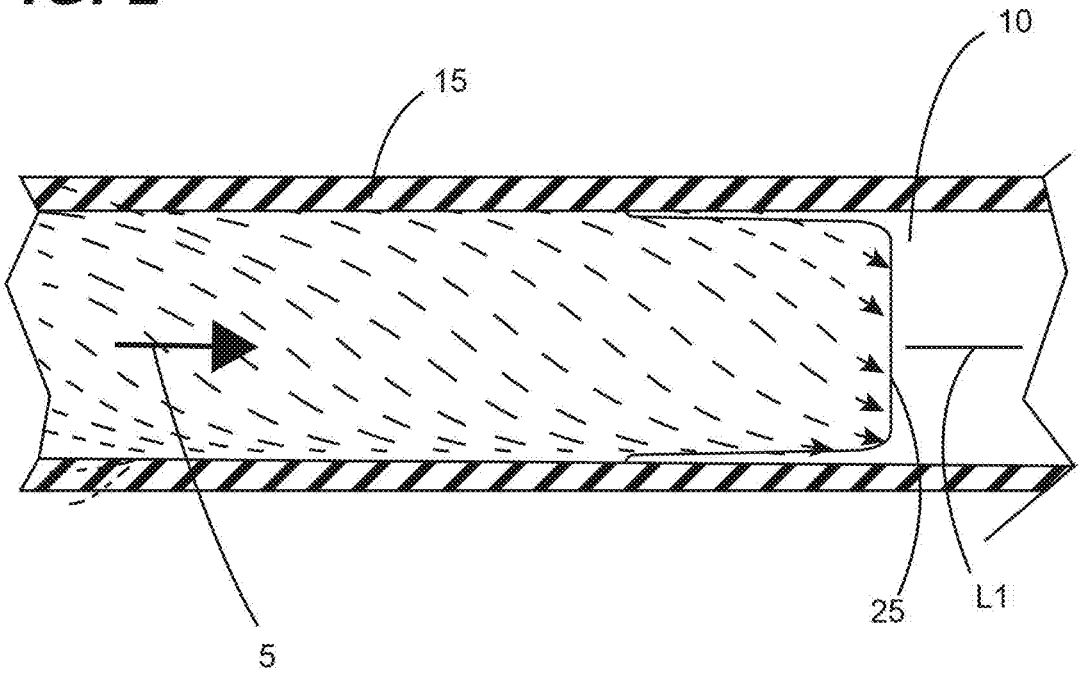
FIG. 2 is a diagrammatic view showing conversion from a laminar flow effect to rotation flow effect by a material flow modifying device configured in accordance with one or more embodiments of the disclosures made herein.
Figure 3:
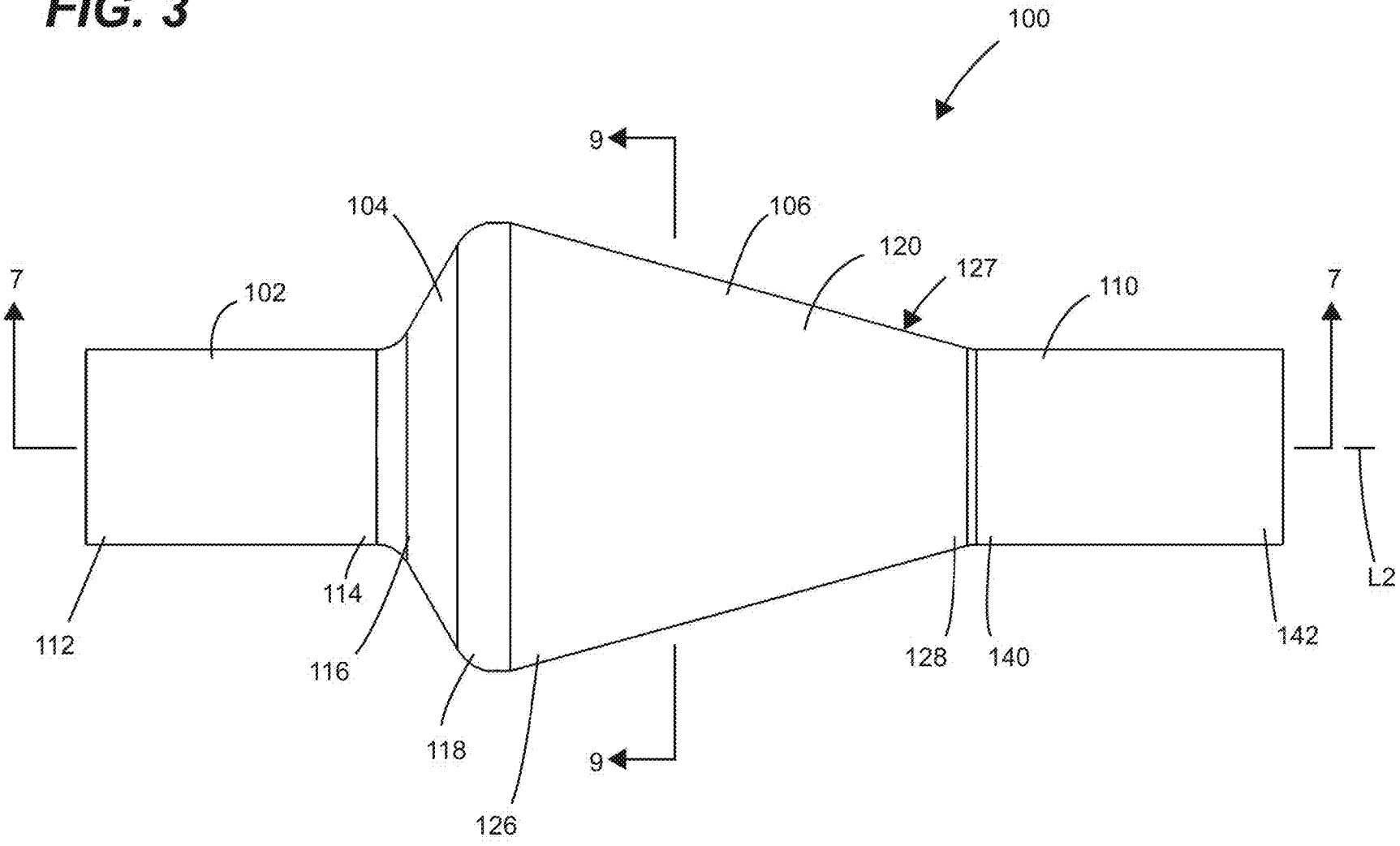
FIG. 3 is a side view of a flow modifying device configured in accordance with one or more embodiments of the disclosures made herein.
Figure 4:
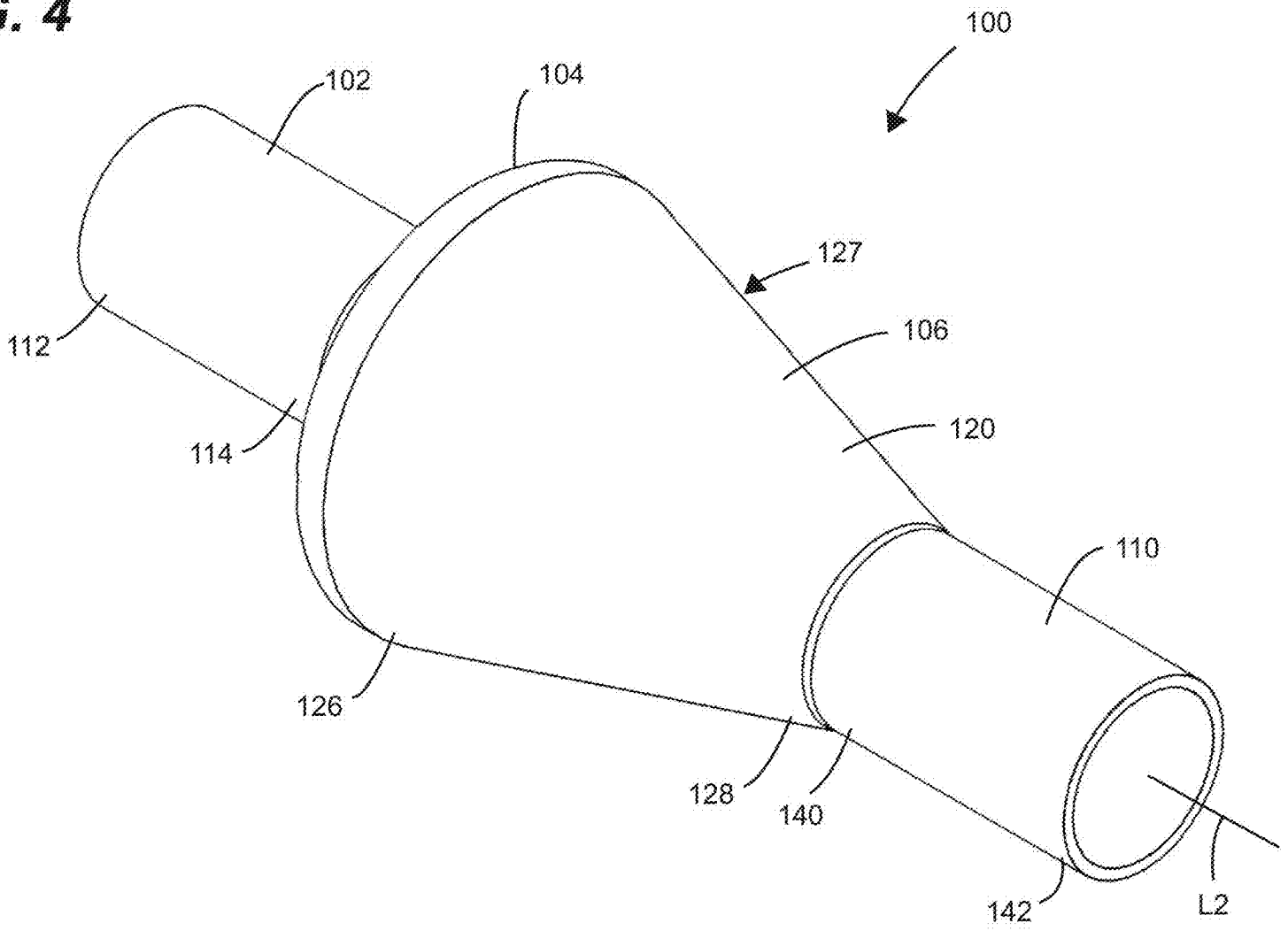
FIG. 4 is a perspective view of the flow modifying device of FIG. 3.
Figure 5:
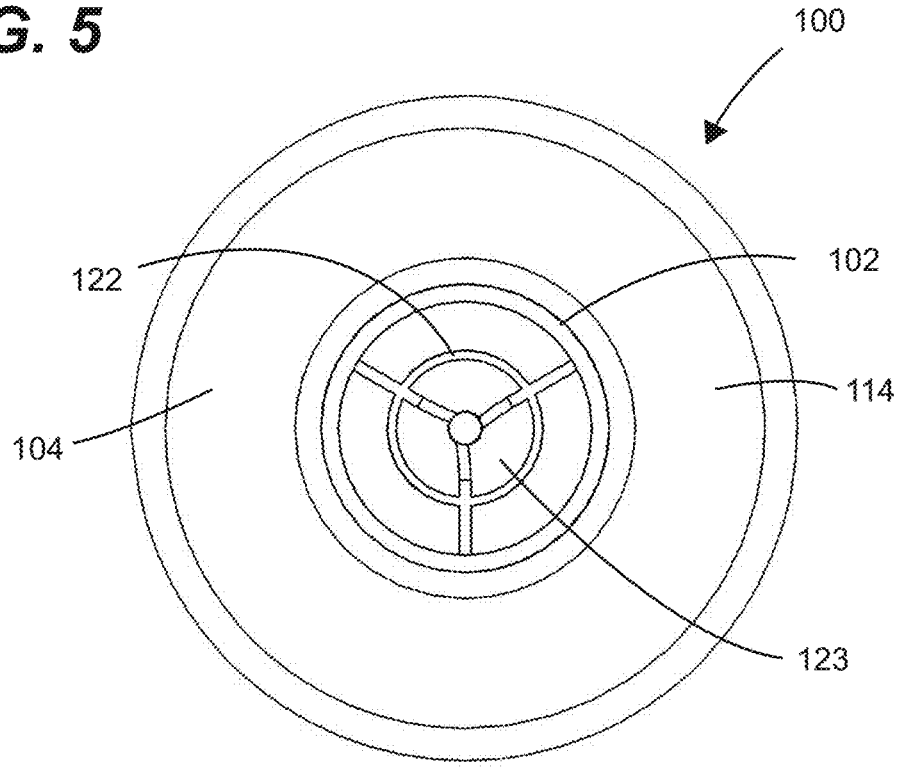
FIG. 5 is an upstream end view of the flow modifying device of FIG. 3.
Figure 6:
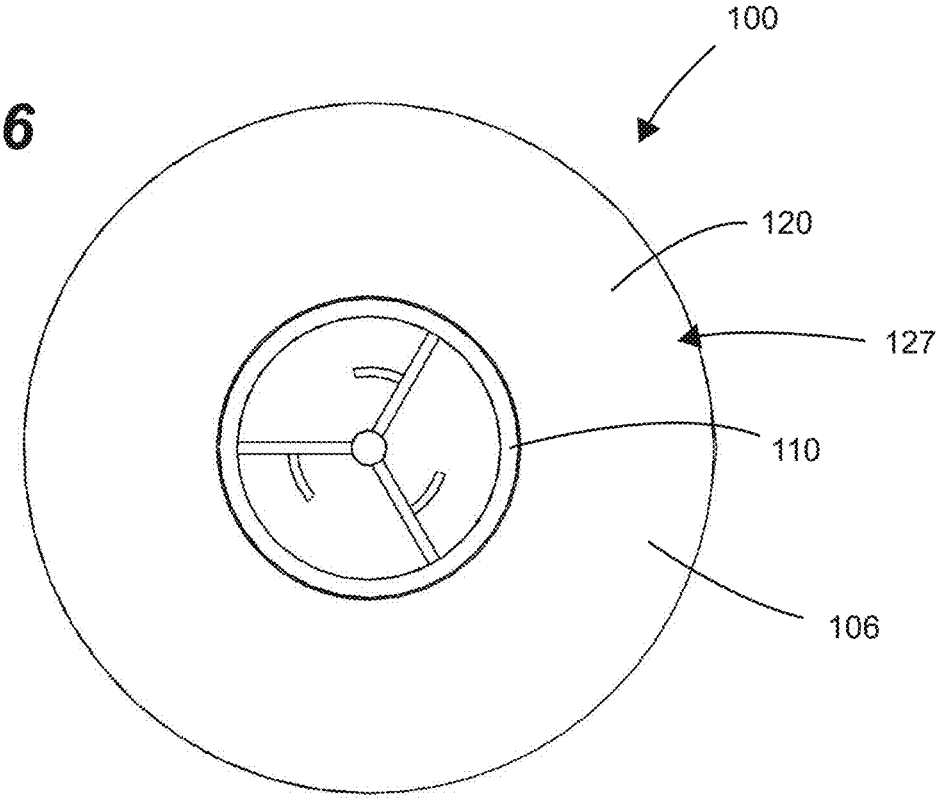
FIG. 6 is a downstream end view of the flow modifying device of FIG. 3.

As a person of ordinary skill in the art will understand (e.g., as depicted in FIGS. 1 and 2), cyclonic flow provides greater average flow velocity and volumetric flow than laminar flow for given flow considerations. Additionally, cyclonic flow mitigates adverse interaction between the surface of the flow conduit and the flowable material. These advantageous aspects of cyclonic flow arise from the cyclonic flow profile accelerating and centralizing flow of the flowable material toward the central portion of the flow passage 10, thereby mitigating associated adverse flow conditions and amplifying flow magnitude. The cyclonic flow also creates a siphoning effect at the inlet, thereby creating a "Push-Pull" effect of the flowable material. The siphoning effect generates material flow momentum, which is beneficial for flowable material transfer. One such beneficial aspect of flowable material transfer is that the volume of material transfer is greatly increased because pumping energy is not used to overcome side wall drag associated with laminar flow. In contrast, this pumping energy is advantageously used to generate greater flow velocity and volumetric flow. To maintain the beneficial effects of cyclonic flow, one or more additional flow modifying devices may be provided downstream of an initial flow modifying device. The distance between adjacent flow modifying devices may be proportional to system attributes such as, for example, flow conduit size, desired flow rates, flow conduit layout, terrain (e.g., elevation grade) and the like.

Referring now to FIGS. 3-9, specific aspects of a flow modifying device in accordance with one or more embodiments of the disclosures made herein (i.e., the flow modifying device 100) are discussed. The flow modifying device 100 includes a flow inlet structure 102, a flow expander 104, a vortex flow inducer 106, and a flow outlet structure 110. The flow inlet structure 102, the flow expander 104, the vortex flow inducer 106, and the flow outlet structure 110 are all in fluid communication with each other for forming a fluid flow path therethrough along the centerline longitudinal axis L2 of the flow modifying device 100. In preferred embodiments, as shown, the flow inlet structure 102, the flow expander 104, the vortex flow inducer 106, and the flow outlet structure 110 are colinearly arranged with each other (e.g., have aligned longitudinal axes) and have common cross-sectional shapes—e.g., round, cylindrical, arcuate.

The flow inlet structure 102 includes an upstream end portion 112 and a downstream end portion 114. In preferred embodiments, the upstream end portion 112 and the downstream end portion 114 of the flow inlet structure 102 are of the same shape and size. However, in other embodiments, the shape and/or size of the upstream end portion 112 and the downstream end portion 114 of the flow inlet structure 102 may be different. The flow inlet structure 102 defines a nominal cross-sectional flow area, which may be more specifically defined by dimensional attributes of the upstream end portion 112 or the downstream end portion 114 of the flow inlet structure 102. For example, where the upstream end portion 112 and the downstream end portion 114 of the flow inlet structure 102 have the same size and shape (e.g., cylinder of a given diameter), the nominal cross-sectional flow area is a circular area of a given among of magnitude.

The flow expander 104 includes an upstream end portion 116 and a downstream end portion 118. The upstream end portion 116 of the flow expander 104 is attached to the downstream end portion 114 of the flow inlet structure 102. The downstream end portion 118 of the flow expander 104 has a first expanded cross-sectional flow area relative to the nominal cross-sectional flow area. In preferred embodiments, the first expanded cross-sectional flow area of the flow expander 104 is established by the flow expander 104 transitioning from a diameter at its upstream end portion 116 that is approximately equal to the diameter of the downstream end portion 114 of the flow inlet structure 102 to a diameter that is greater than the diameter of the downstream end portion 114 of the flow inlet structure 102.

Jointly, the flow inlet structure 102 and the flow expander 104 form the profile of an inverted funnel (i.e., expanding material flow as opposed to converging it). This inversed funnel profile causes flowable material moving through the flow expander 104 to decelerate thereby exhibiting decreased density. This reduction in velocity and decrease in density causes an associated increase in volume. In this respect, the flow volume is expanded as compared to the flow volume at the upstream end portion 116 of the flow expander 104.

The vortex flow inducer 106 includes an outer body 120, a central tube 122, and a plurality of vanes 124. The outer body 120 includes an upstream end portion 126 and a downstream end portion 128. The upstream end portion 126 of the outer body 120 is attached to the downstream end portion 118 of the flow expander 104. The central tube 122 and the plurality of vanes 124 are located within an interior space of the outer body 120. Each of the vanes 124 extends along at least a portion of a length of the outer body 120 and along at least a portion of a length of the central tube 122. In some embodiments, an upstream (i.e., first) end of one or more of the vanes 124 may be located adjacent to or within the flow expander 104 and a downstream (i.e., second) end of one or more of the vanes 124 may be located within the vortex flow inducer 106. The vanes 124 are preferably angularly spaced equidistant from each other (e.g., 3 vanes spaced apart by 120 degrees) but can also be spaced apart from each other in a non-equidistant manner.

The flow inlet structure 102, the flow expander 104, the outer body 120, and the flow outlet structure 110 jointly define a flow modifier body 127. The outer body 120, the central tube 122, and adjacent one of the vanes 124 jointly define respective flow passages 129. Each of the vanes 124 and, thus, each of the flow passages 129, includes a material impinging surface 130 oriented at an angle of incidence to flowable material flowing through the flow inlet structure 102.

In some embodiments, the outer body 120 may be a conically shaped shell (i.e., an outer shell) and the central tube 122 may have a cylindrical cross-sectional shape (i.e., a tubular body having a central passage with a generally uniform cross-sectional area along its length). In some embodiments, the outer body 120 may have a cylindrical cross-sectional shape and the central tube 122 may have a conical shape. The vanes 124 (and associated flow passages) will be longitudinally tapered (i.e., outside diameter gradually reducing) to form a spiral when the outer body 120 is a conically shaped shell (or otherwise has a tapered interior surface) and the central tube 122 is cylindrically shaped. In some embodiments (e.g., where the outer body 120 is a conically shaped shell and the central tube 122 is cylindrically shaped), each of the flow passages 129 exhibits a reduction in cross-sectional area along its length throughout the helical wrap thereof. Such reduction in cross-sectional area promotes enhanced flow amplification and acceleration of the fluid passing therethrough over other embodiments such as, for example, where the outer body 120 is not a conically shaped shell and the central tube 122 is not cylindrically shaped.

Figure 7:
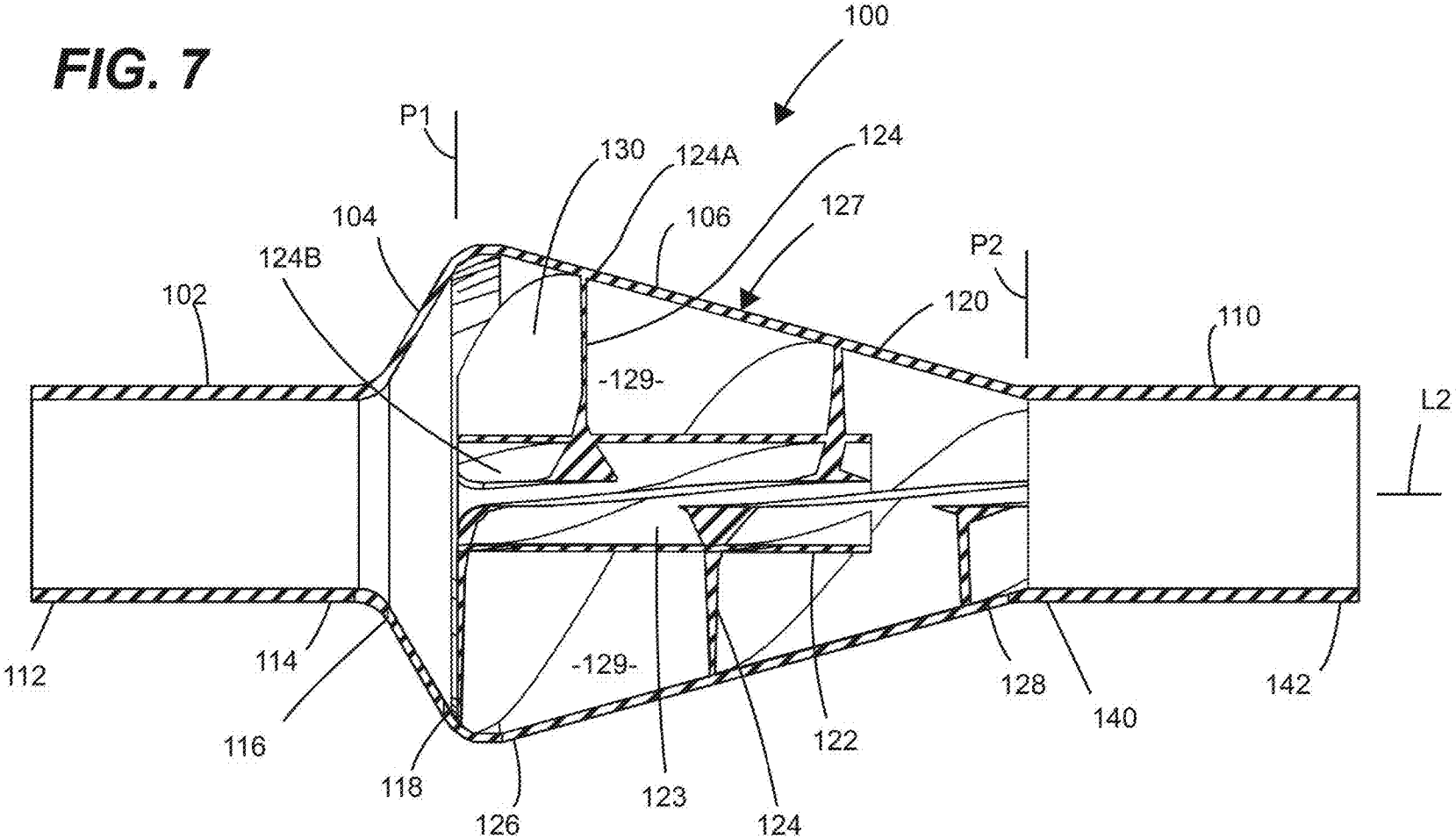
FIG. 7 is a cross-sectional view taken along the line 7-7 in FIG. 3.
Figure 8:
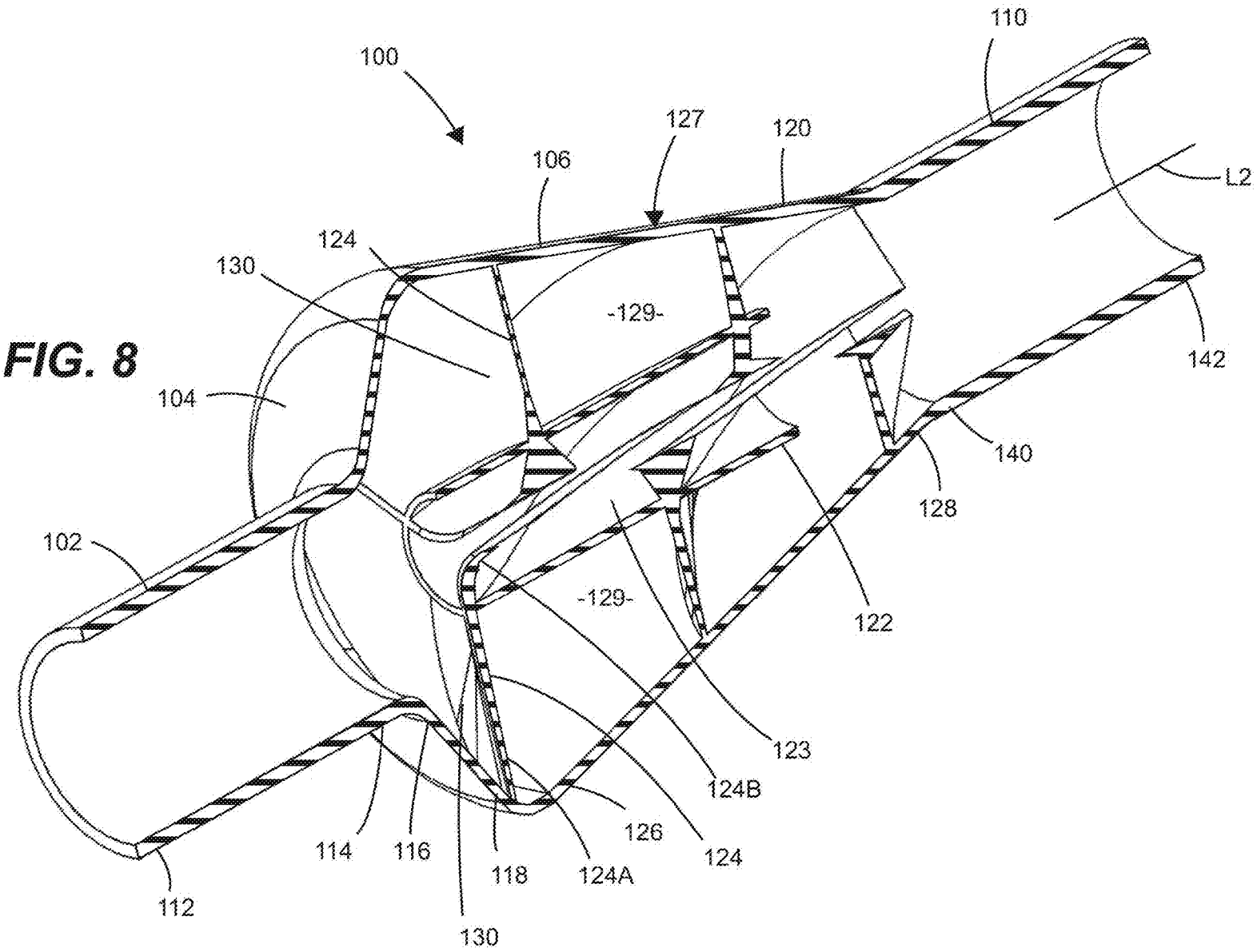
FIG. 8 shows the cross-sectional view of FIG. 7 in perspective orientation.
Figure 9:
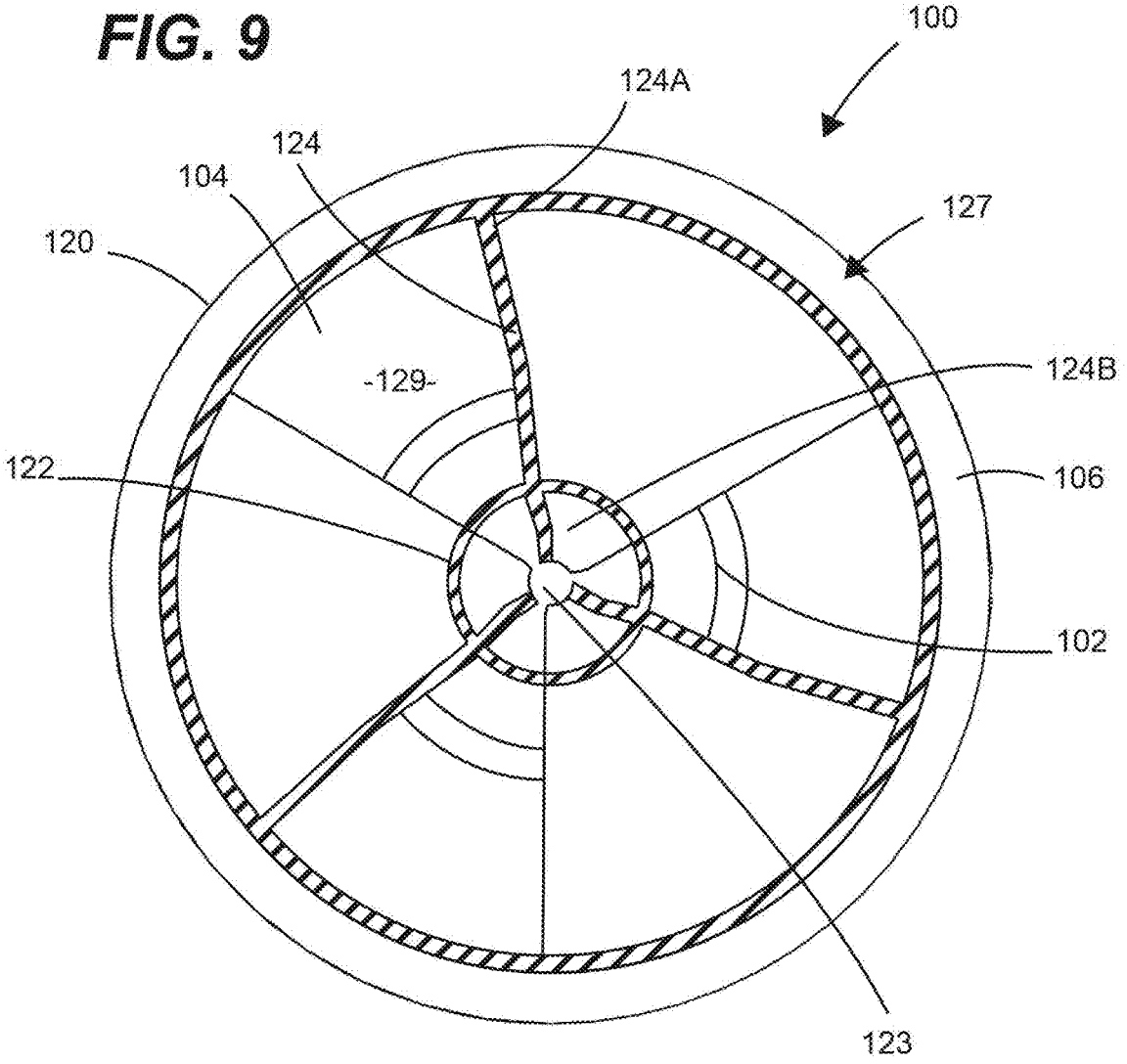
FIG. 9 is a cross-sectional view taken along the line 9-9 in FIG. 3.

As best shown in FIGS. 7-9, an outer edge portion 124A of each of the vanes 124 is integral with the outer body 120 (e.g., attached to or unitarily formed therewith) and an inner edge portion 124B of each of the vanes 124 is located within a central passage 123 of the central tube 122. Preferably, each of the vanes 124 extends contiguously from its outer edge portion 124A to its inner edge portion 124B. As shown, the flow modifying device 100 is of a one-piece construction (e.g., elements of vortex flow inducer unitarily formed such as by casting, molding, 3D printing, or the like) whereby the central tube 122 and the vanes 124 share material at the intersections thereof.

In some embodiments, the central tube 122 and vanes 124 are not of a one-piece construction. For example, the vanes 124 may each be formed as a discrete identical component and be attached to each other by elongated bodies that are positioned between adjacent one of the vanes 124. Segments of the central tube 122 that extend between adjacent ones of the vanes 124 are an example of such elongated bodies. As an assembly, the vanes 124 and the elongated bodies jointly define a structure that is, in at least function, a central tube having a central passage within which inner edge portions 124B of the vanes 124 reside. Preferably, all of the elongated bodies are the same length.

In one or more embodiments, the rotational pitch of each of the vanes 124 is such that each of the vanes 124 can have an angular rotation of from about 90-degrees to about 360-degrees (e.g., as measured about the longitudinal axis L2 of the flow modifying device 100). In one or more other embodiments, the rotational pitch of each of the vanes 124 is such that each of the vanes 124 have an angular rotation of from about 120-degrees to about 270-degrees. The angular rotation may be less than 90 degrees or greater than 180 degrees. In general, overall length of the vanes 124 and the length and volume of the flow passages 129 are proportional to the magnitude (i.e., strength) of the resulting cyclonic flow.

In preferred embodiments, the central tube 122 preferably has a cross-sectional flow area along an entire length thereof that is smaller than the nominal cross-sectional flow area of the flow inlet structure 102. In other embodiments, the central tube 122 has a cross-sectional flow area along an entire length thereof at least about the same as the nominal cross-sectional flow area as defined by an inside diameter of the inlet flow structure 102.

In some embodiments, an upstream end of all of the vanes 124 lay on an upstream reference plane P1 that extends perpendicular to the centerline longitudinal axis L2 of the outer body 120 and an upstream end of the central tube 122 (or elongated bodies comprising same) lay on the upstream reference plane P1. In some embodiments, a downstream end face of all of the vanes 124 lay on a downstream reference plane P2 that that extends perpendicular to the centerline longitudinal axis L2 of the outer body 120 and a downstream end face of the central tube 122 (or elongated bodies comprising same) is located at a position between the upstream and downstream reference planes P1, P2.

The flow outlet structure 110 includes an upstream end portion 140 and the downstream end portion 142. The upstream end portion 140 is attached to the downstream end portion 128 of the outer body 106. In preferred embodiments, the upstream end portion 140 and the downstream end portion 142 of the flow outlet structure 110 are of the same shape and size and can have the same or about same cross-sectional flow area as the inlet flow structure 102 (e.g., the nominal cross-sectional flow area based on a cylindrical tube). However, in other embodiments, the shape and/or size of the upstream end portion 140 and the downstream end portion 142 of the flow outlet structure 110 may be different such as, for example, where the flow outlet structure 110 serves as a flow mixer. In some embodiments, such a flow mixer may have a tubular, cylindrically-shaped upstream end portion immediate followed by a convergently tapering tubular (funnel-like) downstream end portion. The tubular, cylindrically-shaped upstream end portion of the flow mixer may be attached directly to the downstream end portion 128 of the outer body 120. The tubular, cylindrically-shaped upstream end portion of such a flow mixer provides a volumetric space in which material flow through the helical flow passages 126 and the central tube 122 can beneficially merge together.

Flow modifying devices in accordance with one or more embodiments of the disclosures made herein advantageously provide for generation of material flow having cyclonic flow. Though use of helical vanes arranged (e.g., sized and equidistantly spaced) to provide helical flow passage that are enclosed (e.g., sidewalls defined by outer body, the central tube and adjacent vanes) and that are preferably equal in size and volume, resulting cyclonic flow of flowable material flowing through a flow modifying devices in accordance with one or more embodiments of the disclosures made herein is controlled and balanced. In contrast to flow modifying devices that do not include enclosed helical flow passages, flow modifying devices in accordance with one or more embodiments of the disclosures made herein exhibit negligible or no overflow or other flow interaction of flowable material from one helical flow space to another. This isolation of flow mitigates flow imbalances that can cause flow disturbances resulting in adverse flow conditions (e.g., vibrations in flow conduit, pulsations in material flow, eddy currents in material flow, etc.) which can induce structural damage and limit material flow efficiency.

Cyclonic flow as referred to herein preferably includes a "top end" or head that is generated by a flow expander and upstream end portion of the vortex flow inducer and by omnidirectional flow (i.e., generally equal flow in all directions perpendicular to the axis of rotation). Each of the helical flow passages then uses the kinetic energy (i.e., energy from motion) and the flow's velocity to generate several stream vanes of material flow (i.e., helical low streams) that unite with each other downstream of the vortex flow inducer and with the material flow of a centralized flow stream (i.e., flow of the central tube). These material flows are focused to the centerline of the flow modifying device, thereby forming a "tail end" of the cyclonic flow.

Advantageously, inner sidewall conditions of flow conduit (e.g., pipeline) downstream of a flow modifying device has a negligible effect on the cyclonic flow. Although there is a great deal of energy loss from a fluid going through certain disruptive material flow attributes of flow conduits (e.g., a valve, fitting, turbulence created going from passing fluid from one pipe size to another, discontinuity from passing fluid from one form of flow conduit (e.g., solid material) to a different type of flow conduit (e.g., liquid material)), cyclonic flow mitigates energy loss from these disruptive material flow attributes by providing for concentration of material flow along the centerline of material downstream of the flow modifying device thereby reducing perimeter (e.g., sidewall) drag and associated flow resistance.

Flow modifying devices in accordance with one or more embodiments of the disclosures made herein beneficially provide for "soft reverse flow". With such soft reverse flow, if there is ever a back flow surge in a system comprising one or more flow modifying devices in accordance with one or more embodiments of the disclosures made herein, the flow modifying device serves to reduce the backflow (i.e., flow in the upstream direction) as compared to the flow modifying device being absent. Such soft reverse flow beneficially does not fully inhibit backflow, which would create a shock wave that is harmful to the structures of the flow conduit and other inline devices and apparatuses. In a gravity flow system, this is especially beneficial where tide water or flooding could reverse flow in a conventional pipeline system. More specifically, in a reverse flow scenario, flowable material enters the helical flow passages from the flow outlet structure and then dead heads into the 'funnel' of the flow expander, which creates a controlled flow blockage (i.e., controlled funnel flow). In this regard, soft reverse flow is enabled by inclusion of material flow passages defined between the outer body and the central tube.

Flow modifying devices in accordance with embodiments of the disclosures made herein are useful in a variety of pipeline components such as, for example, straight-line components, elbow components, reducing laterals, tees and the like. Flow modifying devices in accordance with embodiments of the disclosures made herein may be installed as a fitting, retrofitted to a section of pipe, or installed into a working pipeline in sections. Flow modifying devices in accordance with embodiments of the disclosures made herein may be used in any right-hand or left-hand flow angles which also includes vertical up and vertical down applications.

Flow modifying devices in accordance with embodiments of the disclosures made herein may be implemented in a propulsion system—e.g., as an integral or add-on component thereof. Rotational flow provides by such a flow modifying device (i.e., a propulsion enhancing device) will exits the propulsion system in a manner where portions of a surrounding body of water act as an annulus that maintains the rotational flow profile beyond exit of the rotating material flow from propulsion system (i.e., an in-situ fluid-defined conduit). Thrust and torque propulsion afforded by such a propulsion enhancing device extends past the outlet of the propulsion enhancing device to a point that depends on the volumetric flow rate (e.g., (gallons per minute—i.e., "GPM") of operation of an upstream propulsion unit that provides for energizes the flow of water through the propulsion enhancing device.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A flow modifying device, comprising:

an outer body;

a plurality of vanes each extending in a helical manner within the outer body along at least a portion of a length of the outer body, wherein at least a portion of an outer edge portion of each of the vanes is attached to the outer body, wherein an inner edge portion of each of the vanes is located adjacent to a centerline longitudinal axis of the outer body, and wherein the inner edge portion of each of the vanes is spaced away from the inner edge portion of each other one of the vanes; and a plurality of elongated bodies each extending between respective adjacent ones of the vanes, wherein each of the adjacent vanes is attached to the elongated body extending therebetween, wherein the elongated bodies and the vanes jointly define a central passage extending along the centerline longitudinal axis of the outer body, and wherein each of the elongated bodies is located at a position between the outer and inner edge portions of each of the respective adjacent ones of the vanes.

2. The flow modifying device of claim 1 wherein each of the vanes extends contiguously from the outer edge portion thereof to the inner edge portion thereof.

3. The flow modifying device of claim 1 wherein:

the vanes and the elongated bodies jointly define a central tube that is cylindrically shaped; and the central passage extends through the central tube.

4. The flow modifying device of claim 3 wherein the outer body is conically shaped.

5. The flow modifying device of claim 1 wherein each elongated body is located adjacent to the inner edge portion of the adjacent ones of the vanes.

6. The flow modifying device of claim 1 wherein:

an upstream end of all of the vanes lay on an upstream reference plane;

an upstream end of all of the elongated bodies lay on the upstream reference plane; and the upstream reference plane extends perpendicular to the centerline longitudinal axis of the outer body.

7. The flow modifying device of claim 6 wherein:

a downstream end face of all of the vanes lay on a downstream reference plane that extends parallel to the upstream reference plane;

a downstream end face of all of the elongated bodies are located at a position between the upstream and downstream reference planes; and all of the elongated bodies are the same length.

8. The flow modifying device of claim 6 wherein the outer body is conically shaped.

9. The flow modifying device of claim 6 wherein:

the vanes and the elongated bodies jointly define a central tube that is cylindrically shaped; and the central passage extends through the central tube.

10. The flow modifying device of claim 9 wherein the outer body is conically shaped.

11. The flow modifying device of claim 10 wherein:

a downstream end face of all of the vanes lay on a downstream reference plane;

a downstream end face of all of the elongated bodies are located at a position between the upstream and downstream reference planes; and all of the elongated bodies are the same length.

12. The flow modifying device of claim 1 wherein:

a downstream end face of all of the vanes lay on a downstream reference plane that extends parallel to the upstream reference plane;

a downstream end face of all of the elongated bodies are located at a position upstream of the downstream reference plane;

all of the elongated bodies are the same length.

13. The flow modifying device of claim 12 wherein:

the outer body is conically shaped;

the vanes and the elongated bodies jointly define a central tube that is cylindrically shaped; and the central passage extends through the central tube.

14. A flow modifying device, comprising:

an outer shell;

a central tube within an interior space of the outer shell, wherein the central tube extends along at least a portion of a length of the outer shell; and a plurality of helix vanes within the interior space, wherein each of the helix vanes extend along at least a portion of a length of the outer shell and along at least a portion of a length of the central tube and wherein at least a portion of an outer edge portion of each of the helix vanes is attached to the outer shell and an inner edge portion of each of the helix vanes is located within a central passage of the central tube such that a first portion of each of the helix vanes extends between the outer shell and the central tube and a second portion of each of the helix vanes is located within the central passage of the central tube.

15. The flow modifying device of claim 14 wherein:

the outer shell is conically shaped; and the central tube is cylindrically shaped.

16. The flow modifying device of claim 14 wherein:

an upstream end of all of the helix vanes lay on an upstream reference plane;

an upstream end of all of the elongated bodies lay on the upstream reference plane;

the upstream reference plane extends perpendicular to the centerline longitudinal axis of the outer shell;

a downstream end face of all of the helix vanes lay on a downstream reference plane that extends parallel to the upstream reference plane;

a downstream end face of all of the elongated bodies are located at a position between the upstream and downstream reference planes; and all of the elongated bodies are the same length.

17. The flow modifying device of claim 16 wherein:

the outer shell is conically shaped; and the central tube is cylindrically shaped.

18. A flow modifying device, comprising:

an outer shell that is conically shaped;

a central tube within an interior space of the outer shell, wherein the central tube is cylindrically shaped, wherein the central tube extends along at portion of a length of the outer shell such that a length of the central tube is less than the length of the outer shell; and a plurality of vanes extending in a helical manner within the outer shell, wherein each of the vanes extend along at least a portion of a length of the outer shell and along at least a portion of a length of the central tube, wherein at least a portion of an outer edge portion of each of the vanes is integral with the outer shell and an inner edge portion of each of the vanes is located within a central passage of the central tube such that a first portion of each of the vanes extends between the outer shell and the central tube and a second portion of each of the vanes is located within the central passage of the central tube, wherein each of the vanes extends contiguously from the outer edge portion thereof to the inner edge portion thereof, and wherein adjacent ones of the vanes, the outer shell and the central tube jointly define a respective helical fluid flow passage.

19. The flow modifying device of claim 18 wherein:

an upstream end of all of the vanes lay on an upstream reference plane;

an upstream end of the central tube lays on the upstream reference plane; and the upstream reference plane extends perpendicular to the centerline longitudinal axis of the outer shell.

20. The flow modifying device of claim 19 wherein:

a downstream end face of all of the vanes lay on a downstream reference plane that extends parallel to the upstream reference plane; and a downstream end face of the central tube is at a position between the upstream and downstream reference planes.

* * * * *